US006155873A

United States Patent [19]

Chang

[11] Patent Number: 6,155,873

[45] Date of Patent: Dec. 5, 2000

[54] STACKED ELECTRICAL CONNECTOR

[75] Inventor: Yao-Hao Chang, Tu-Chen, Taiwan

[73] Assignee: Hon Hai Precision Ind. Co., Ltd., Taipei Hsien, Taiwan

[21] Appl. No.: 09/378,614

[22] Filed: Aug. 20, 1999

[30] Foreign Application Priority Data

Oct. 30, 1998 [TW] Taiwan ..... 87217994

[51] Int. Cl.[7] ..... H01R 13/73

[52] U.S. Cl. ..... 439/541.5

[58] Field of Search ..... 439/541.5, 79

[56] References Cited

U.S. PATENT DOCUMENTS 5,643,008 7/1997 Tan et al. ..... 439/541.5
5,695,362 12/1997 Hillbish et al. ..... 439/541.5
5,755,592 5/1998 Hillbish et al. ..... 439/541.5
5,800,207 9/1998 Hsu et al. ..... 439/541.5
5,851,125 12/1998 Hsu et al. ..... 439/541.5

*Primary Examiner*—Gary F. Paumen
*Attorney, Agent, or Firm*—Wei Te Chung

[57] ABSTRACT

A stacked electrical connector connected to a circuit board includes a frame, an upper and lower and a plurality of upper and lower terminals. The frame receives the upper and lower. Each terminal includes a contacting section, an engaging section and a soldering section. The soldering section has a horizontal portion and a vertical portion. The horizontal portion comprises a connection plate and a body. The connection plate is connected with the body in a different direction relative to the engaging section. The vertical portion comprises two sections having a different cross-sectional area, and a bevel surface formed between the two sections for enhancing the rigidity of the terminal.

8 Claims, 6 Drawing Sheets

STACKED ELECTRICAL CONNECTOR

BACKGROUND OF THE INVENTION

The present invention relates to a stacked electrical connector, and particularly to a stacked electrical connector with rigid terminals for securely engaging with a mating connector.

A conventional stacked electrical connector has different terminals for engaging with different mating connectors. Referring to FIGS. 5A and 5B, a terminal 70 comprises a contacting section 71, an engaging section 72 and a soldering section 73. The contacting section 71 is formed by a stamping process and the engaging section 72 extends from the contacting section 71. The engaging section 72 further comprises a shoulder 721. The soldering section 73 extends from the shoulder 721. The soldering section 73 is L-shaped and comprises a horizontal portion 731 and a vertical portion 732. The horizontal portion 731 is perpendicular to the vertical portion 732 and both portions 731, 732 have the same cross sectional area. When the vertical portion 73 is inserted into a circuit board (not shown), a mating force is exerted on the terminal 70 with a moment. Thus, the conventional terminal 70 will eventually become deformed. Thus, a new design is required to overcome such a disadvantage.

BRIEF SUMMARY OF THE INVENTION

A main object of the present invention is to provide a stacked electrical connector securely mounted on a circuit board while effectively preventing terminals thereof from becoming deformed during assembly.

To fulfill the above mentioned object, a stacked electrical connector comprises a frame, a spacer, a plurality of boardlocks, a plurality of upper and lower terminals, a shroud and an upper and lower insulative housing. The frame comprises a bracket and a number of locking arms. Each terminal comprises a contacting section, an engaging section and a soldering section. The engaging section has a shoulder connecting with the contacting section. The soldering section has a horizontal portion and a vertical portion. The horizontal portion comprises a connection plate and a body. The connection plate is perpendicularly connected to the body relative to the engaging section. The vertical portion has a bevel surface for enhancing the rigidity of the terminal.

Other objects, advantages and novel features of the invention will become more apparent from the following detailed description when taken in conjunction with the accompanying drawings.

DETAILED DESCRIPTION OF THE INVENTION

Figure 1:
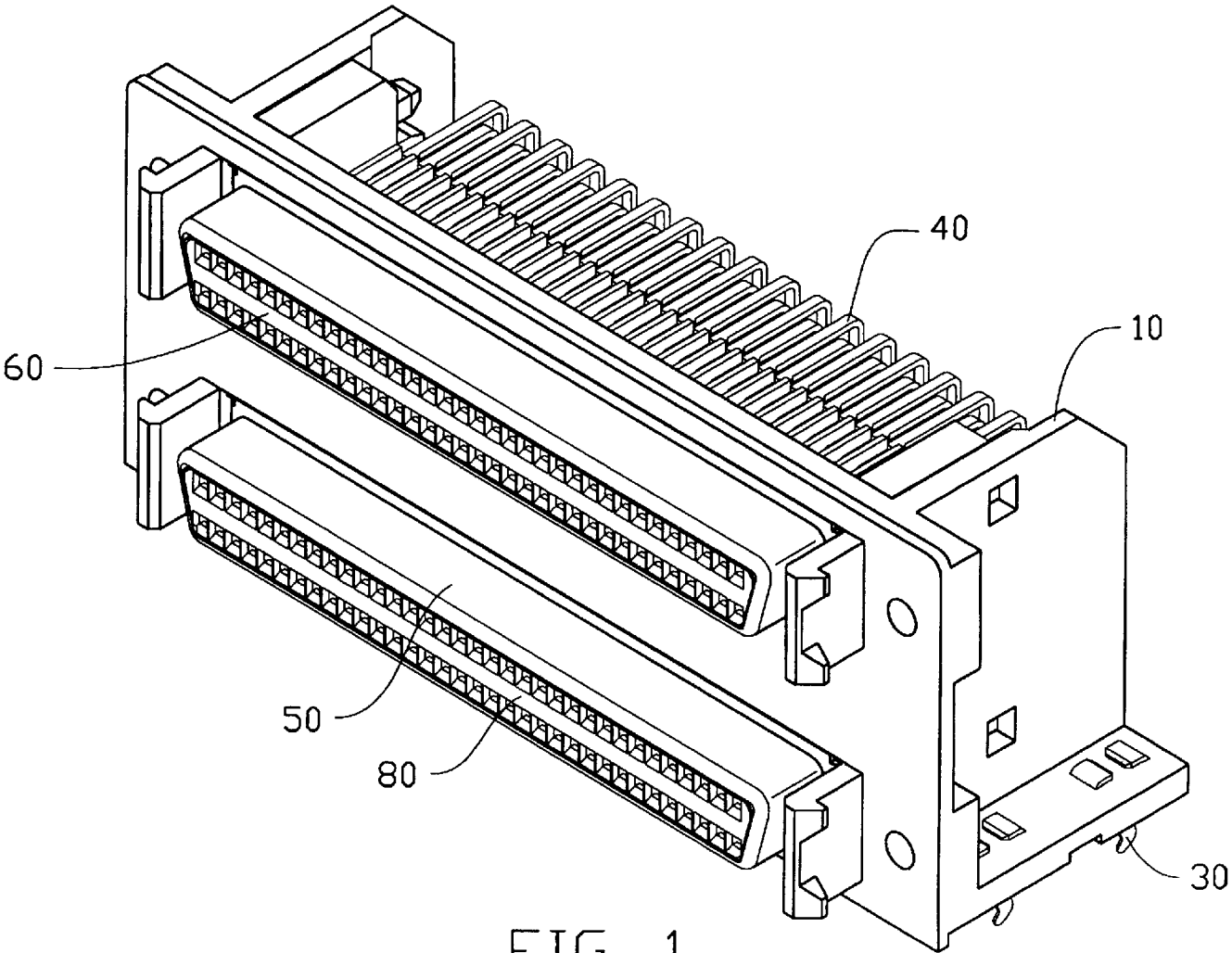
FIG. 1 is a perspective view of a stacked electrical connector in accordance with the present invention.
Figure 2:
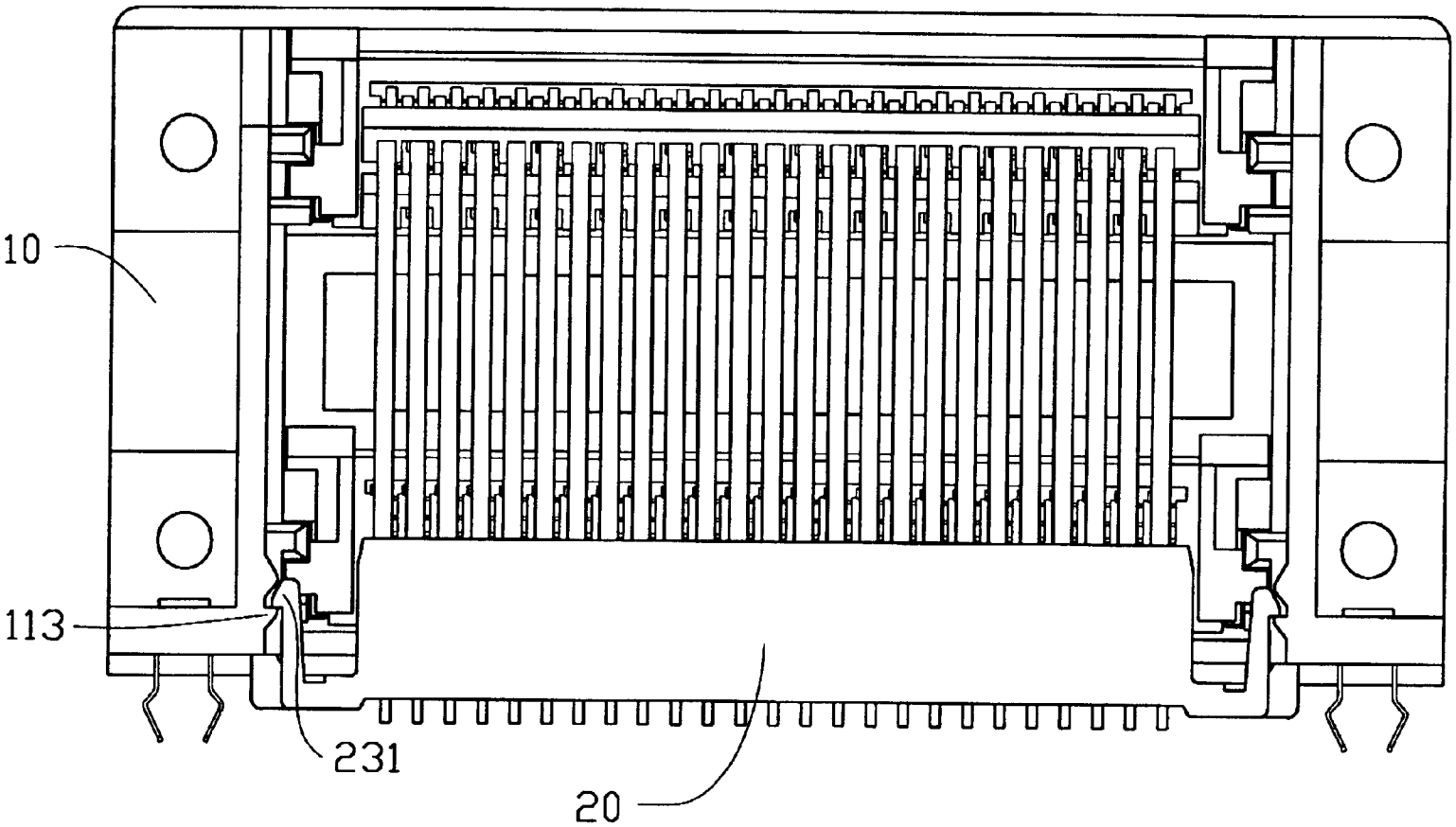
FIG. 2 is a rear view of FIG. 1.

Referring to FIGS. 1 to 3B, a stacked electrical connector in accordance with the present invention comprises a frame 10, a spacer 20, a plurality of boardlocks 30, a plurality of upper and lower terminals 40, 70, a metal shroud 50 and an upper and lower insulative housing 60, 80. The frame 10 comprises a bracket 11 and two pairs of locking arms 12. An upper and lower openings 111, 1110 are formed in a front wall 118 of the bracket 11 for receiving the upper and lower insulative housing 60, 80. A pair of projections 116 is formed on opposite edges of the opening 111. A pair of locking cavities 114 is formed in opposite side walls 110 of the bracket 11. Each locking arm 12 comprises a locking foot 121, a locking projection 122, a receiving groove 123 and an engaging wall 124. In assembly, the locking projection 122 locks with a mating connector. The locking foot 121 extends into the opening 114 and the engaging wall 124 of the locking arm 12 is positioned by the projection 116. Thus, the locking arm 12 is secured to the bracket 11. A plurality of fixing holes 112 is formed in opposite sides of the bracket 11 for engaging with the boardlocks 30 and securing the frame 10 to a circuit board (not shown).

The upper and lower insulative housings 60, 80 are received in the corresponding openings 111. The upper housing 60 has an engaging section 61 defining a plurality of passageways 64 for receiving the terminals 40 therein and being surrounded by the corresponding shroud 50. In assembly, the engaging section 61 is received in the corresponding opening 111, and a guiding portion 62 of the housing will slide into receiving groove 123 of the corresponding locking arm 12. A locking element 63 engages with locking cavities 114 of the bracket 11. Thus, the housing 60 is securely fixed to the frame 10.

The spacer 20 forms a plurality of holes 21 for properly positioning the corresponding terminals 40, 70 therein. A pair of guide posts 22 and a pair of locking tabs 23 are formed on opposite sides of the spacer 20. The guide posts 22 are inserted into holes 117 formed in the bracket 11 for positioning the frame 10. A protrusion 231 is formed at an end of each locking tab 23 for engaging with a projection 113 of the bracket 11. Thus, the spacer 20 is secured to the frame 10 by the guide posts 22 and the locking tabs 23.

Each boardlock 30 comprises a head 31 and a pair of feet 32. The head 31 engages with the corresponding fixing hole 112 of the bracket 11 and has a U-shape structure. Each foot 32 forms a barb for engaging with the circuit board.

Figure 4B:
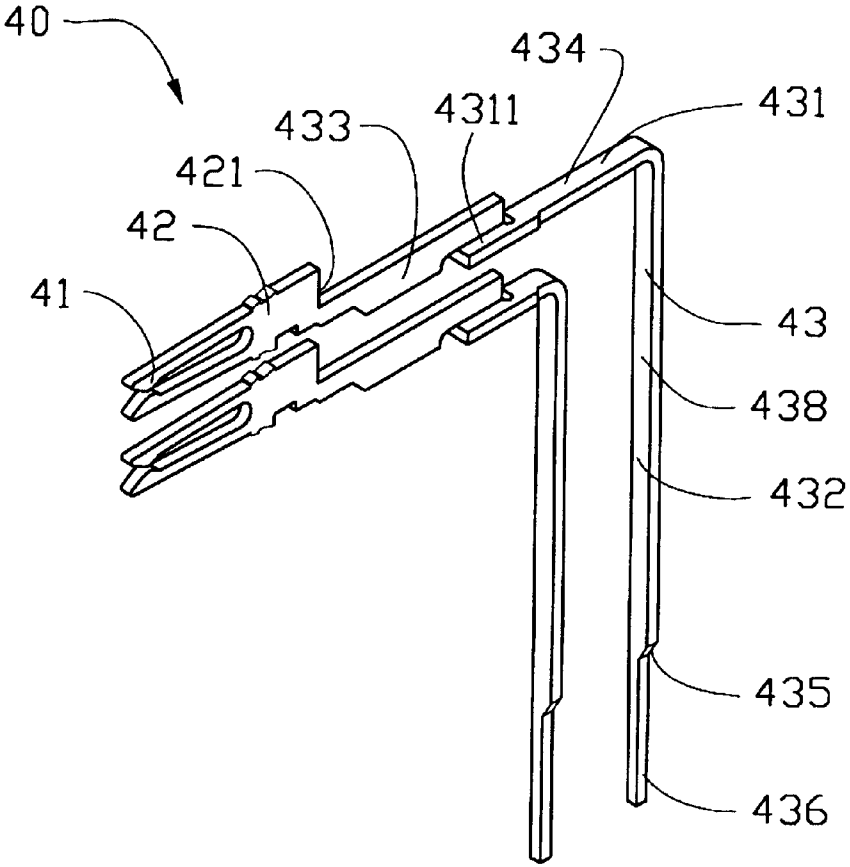
FIG. 4B is a perspective view of FIG. 4A.
Figure 4A:
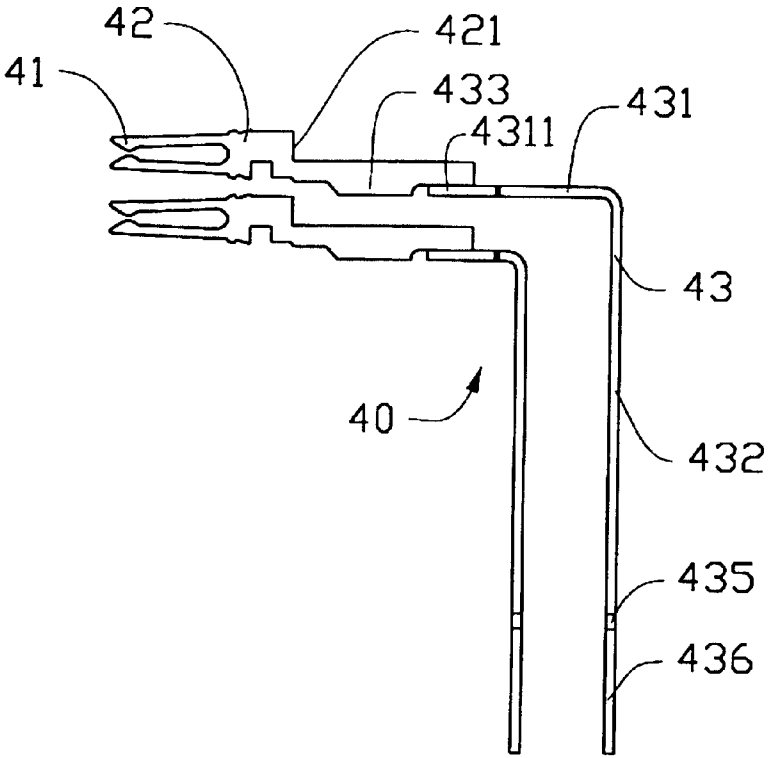
FIG. 4A is a side view of a terminal in accordance with the present invention.
Figure 5B:
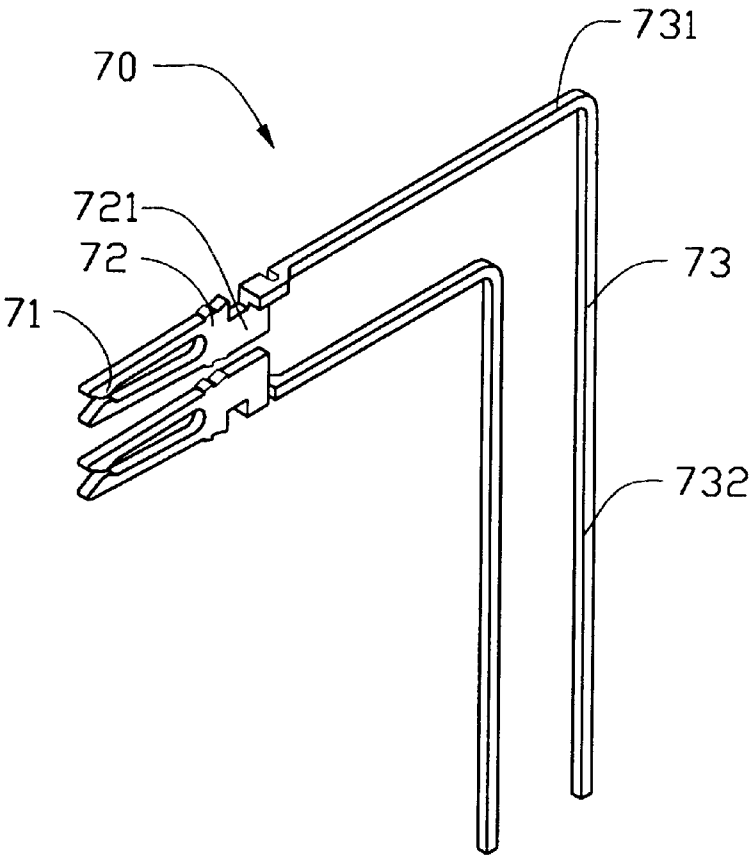
FIG. 5B (PRIOR ART)
FIG. 5B is a perspective view of the conventional terminal.
Figure 5A:
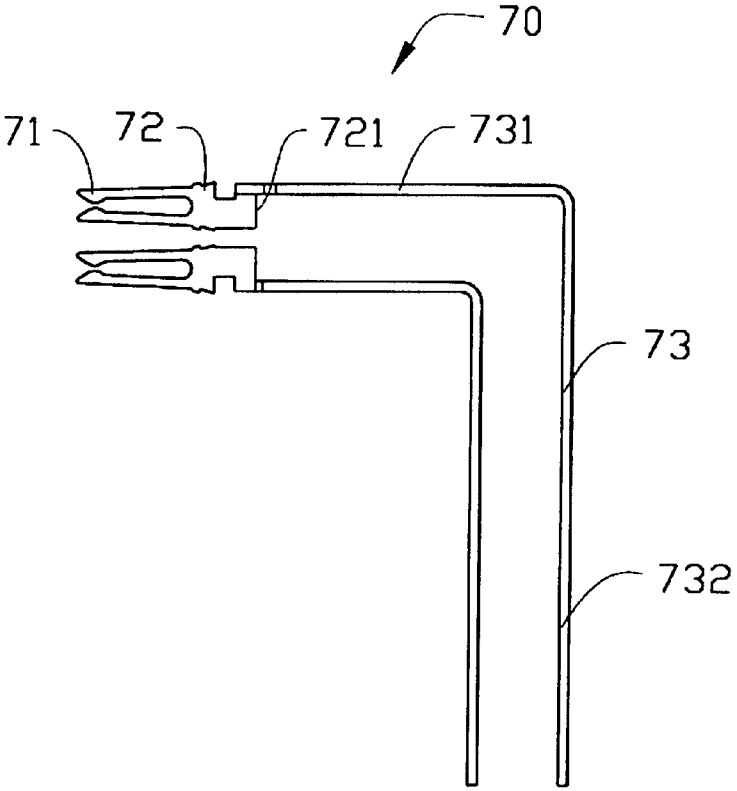
FIG. 5A (PRIOR ART)
FIG. 5A is a side view of a conventional terminal.

Referring to FIGS. 4A and 4B, the upper terminals 40 comprises a contacting section 41, an engaging section 42 and a soldering section 43.

The engaging section 42 has a shoulder 421. The soldering section 43 has a horizontal portion 431 and a vertical portion 432. The horizontal portion 431 comprises a connection plate 433 and a body 434. The connection plate 433 is perpendicular to the body 434 and a connection portion 4311 is proximate the vertical portion 432. Upper and lower sections 433, 436 of the vertical portion 432 have a different cross-sectional area, and a bevel surface 435 is formed therebetween for enhancing the rigidity of the terminal 40.

Figure 3A:
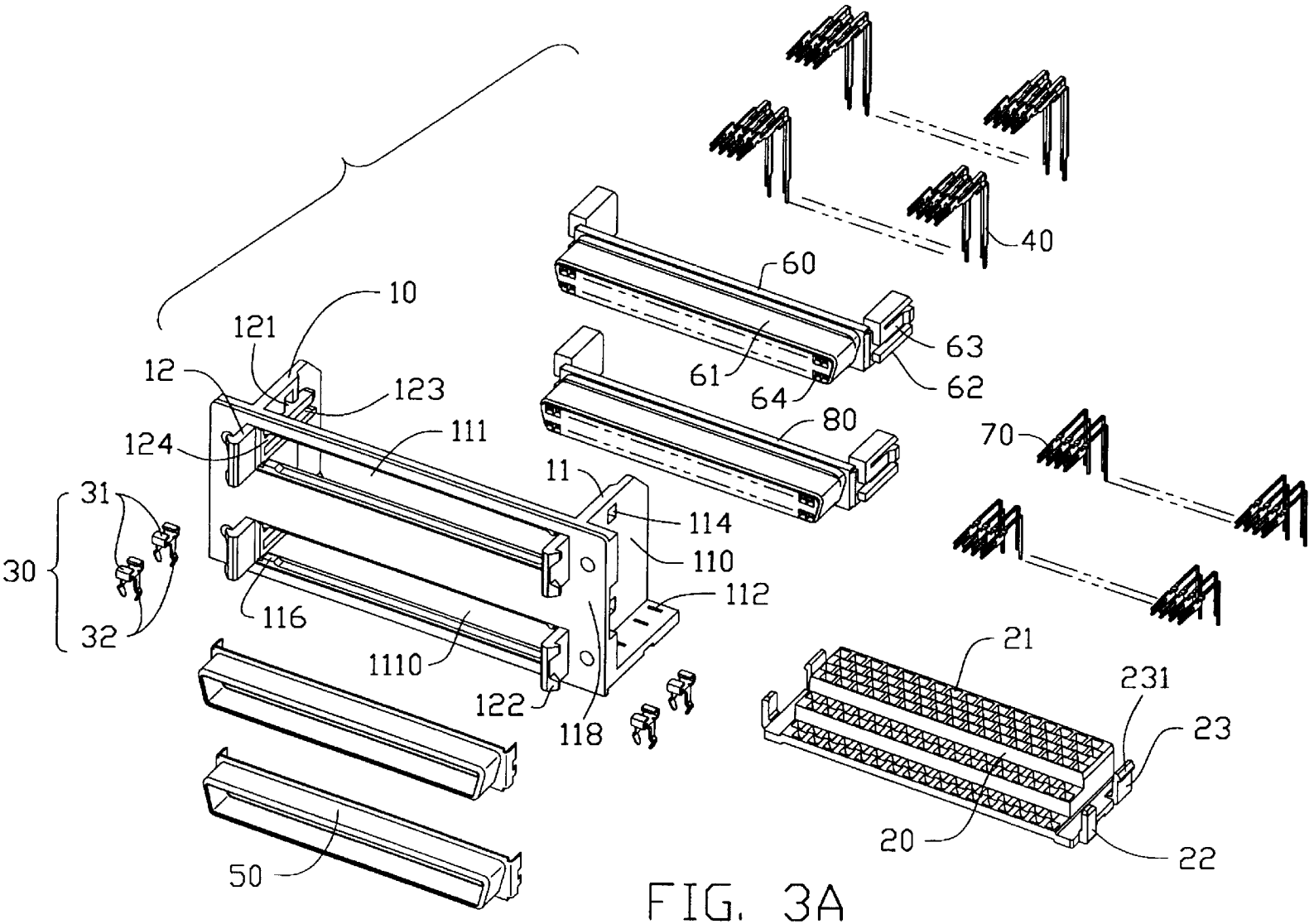
FIG. 3A is an exploded view of FIG. 1.
Figure 3B:
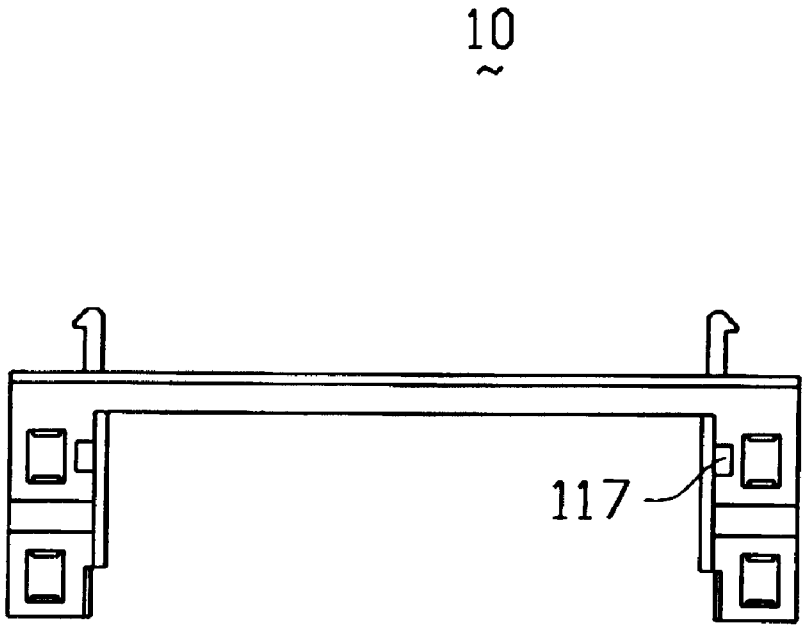
FIG. 3B is a bottom view of a frame of the stacked electrical connector in accordance with the present invention.

Also referring to FIG. 3A, the lower section 436 of each terminal 40 is inserted into the corresponding hole 21 of spacer 20. The contacting section 41 and the engaging section 42 of each terminal 40 are received in the corresponding passageway 64 of the housing 60. A resistance force acts on the vertical portion 432 of the terminal 40 and forms a moment acting on the horizontal portion 431.

However, the connection plate 433 of the horizontal portion 431 is perpendicular to the body 434 whereby rigidity of terminal 40 is effectively enhanced and deformation thereof is less than the conventional terminals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical connector comprising:

a bracket having an upper opening, a lower opening, and a pair of locking arms respectively formed at lateral sides thereof;

an upper and a lower insulative housings being received in the upper and the lower openings, respectively, each insulative housing having an engaging section defining a plurality of passageways; and a plurality of upper and lower terminals being received in the passageways of corresponding upper and lower insulative housings, each upper terminal having a contacting section, an engaging section and a soldering section, the soldering section including a horizontal portion and a vertical portion, a connection portion between the engaging section and the solder section being so positioned as to enhance rigidity of the horizontal portion;

wherein the horizontal portion of the soldering section has a connection plate and a body, the connection plate being bent approximately ninety degrees relative to the body at a bend, the bend being spaced a substantial distance from the contacting section and the engaging section, the connection plate having a vertical dimension substantially greater than that of the body.

2. The stacked electrical connector as claimed in claim 1, wherein the connection portion is formed near the end of the connection portion and proximal to the vertical portion.

3. The stacked electrical connector as claimed in claim 1, wherein each insulative housing forms a pair of guiding portions at lateral sides thereof and each locking arm of the bracket comprises a receiving groove for engaging the guiding portions.

4. The stacked electrical connector as claimed in claim 1, wherein the engaging section of the housing is surrounded around by a metal shroud.

5. The stacked electrical connector as claimed in claim 1, wherein the engaging section of each terminal is received in the corresponding passageway of the corresponding housing for securing the terminal therein.

6. The stacked electrical connector as claimed in claim 1, wherein the vertical portion comprises two sections each having different cross-sectional area, a bevel surface being formed at a junction portion formed between the two sections.

7. The stacked electrical connector as claimed in claim 1, wherein a spacer forms a plurality of holes for positioning corresponding terminals therein.

8. An electrical connector comprising:

an insulative housing defining a plurality of passageways;

a plurality of terminals received within said passageways, respectively; and each of said terminals including a contact section, an engaging section and a soldering section, said soldering section including a horizontal portion and a vertical portion, said horizontal portion further including a connection plate and a body, wherein said body is a horizontal strap, and said connection plate extends a significant distance in a same plane with the engaging section and the contacting section while perpendicular to said body so as to enforce rigidity of the horizontal portion.

* * * * *